US006640970B1

(12) United States Patent
Townsend, Jr.

(10) Patent No.: US 6,640,970 B1
(45) Date of Patent: Nov. 4, 2003

(54) GOLF CLUB CARRIER

(76) Inventor: Charles E. Townsend, Jr., 11 Ranch Rd., Orinda, CA (US) 94563

( * ) Notice: Subject to any disclaimer, the term of this patent is extended or adjusted under 35 U.S.C. 154(b) by 0 days.

(21) Appl. No.: 10/099,406

(22) Filed: Mar. 14, 2002

(51) Int. Cl.[7] ..... A63B 55/10

(52) U.S. Cl. ..... 206/315.2; 206/315.6; 211/70.2

(58) Field of Search ..... 206/315.2, 315.3, 206/315.6; 211/70.2; 294/143; D3/259

(56) References Cited

U.S. PATENT DOCUMENTS

| | | | | | |
|---|---|---|---|---|---|
| 936,698 | A | * | 10/1909 | Breakspear | 206/315.2 |
| 1,314,171 | A | | 8/1919 | Vogel | 206/315.2 |
| D186,029 | S | | 9/1959 | Sasaki | D3/320 |
| 3,455,358 | A | | 7/1969 | Kuzma | 206/315.2 |
| D237,396 | S | | 10/1975 | Herring | D3/320 |
| 4,371,022 | A | | 2/1983 | Goulart | 206/315.2 |
| D322,831 | S | | 12/1991 | Cantwell | D21/233 |
| 5,238,109 | A | | 8/1993 | Smith | 206/315.2 |
| 5,314,079 | A | * | 5/1994 | Young | 211/70.2 |
| 5,425,452 | A | | 6/1995 | Shanks et al. | 206/315.7 |
| D372,126 | S | | 7/1996 | Martinez et al. | D3/320 |
| 5,540,431 | A | | 7/1996 | Crozier | 473/282 |
| 5,918,737 | A | * | 7/1999 | Kwon | 206/315.3 |
| 5,984,395 | A | | 11/1999 | Halpen | 294/143 |
| D433,566 | S | | 11/2000 | Larko | D3/255 |
| 6,383,088 | B1 | | 5/2002 | Kershner | 473/282 |

FOREIGN PATENT DOCUMENTS

| | | | |
|---|---|---|---|
| WO | 9118650 | 12/1981 | 206/315.3 |

* cited by examiner

*Primary Examiner*—Sue A. Weaver
(74) *Attorney, Agent, or Firm*—Townsend and Townsend and Crew LLP; Guy W. Chambers

(57) ABSTRACT

A golf club carrier for holding a preselected relatively few clubs (e.g., three clubs) from a larger set (e.g., 14 clubs) container in a standard size golf bag. The carrier includes an elongate substantially rigid hollow tubular body into which the preselected few clubs are loaded, and a hook-shaped handle secured to and extending above the open top of the tubular body. The handle includes an elongate outer leg extending downwardly in parallel spaced relation to the elongate body to a terminal point within the center of balance of the carrier when it is loaded with one or more preselected clubs. The outer leg is arranged and constructed to hook over the rim of the larger parent bag when the latter is mounted upright on the platform of a conventional motorized golf cart. A second embodiment includes a novel hinged handle lift bar to provide a raised finger grip to facilitate raising and lowering of the carrier from and to ground level.

5 Claims, 8 Drawing Sheets

GOLF CLUB CARRIER

BACKGROUND OF THE INVENTION

This invention relates to a novel golf club carrier for carrying only a few (optimally three) clubs selected from a set of clubs (e.g. fourteen) contained in a larger or parent golf bag.

BRIEF DESCRIPTION OF THE PRIOR ART

Heretofore, there have been marketed golf clubs or carriers designed to carry only a limited few number of golf clubs. Most of these compact bags include a conventional type shoulder strap and/or luggage-type hand grip. Many are provided with a foldable stand to maintain the bag in semi-upright position, while others are equipped with about a 6" long ground spike to maintain them in upright position. Most of these compact light weight bags and club carriers are merely for the purpose of permitting a golfer to carry only a few clubs around a course, rather than having to lug a larger and more cumbersome standard bag.

The idea of providing a canvas bag of limited club capacity and using it in conjunction with a full size bag mounted on a golf cart to carry a few selected clubs to a fairway location remote from the cart is, per se, also known.

In addition, the use of a single golf tube with a clip on its upper lip to clamp-on to the rim of a golf bag for the sole purpose of carrying a putter (single club) outside the golf bag is known. In use, the golfer removes the putter from the tube, leaving the tube itself clamped to the rim of the bag.

BRIEF SUMMARY OF THE INVENTION

In general, the invention comprises the combination of a slender, elongate, tubular body portion into which may be loaded a few clubs (optimally three) selected from a larger set of clubs contained in a standard size golf bag, and an elongate hooked-shaped handle which is designed to serve multifold functions to be described.

Besides providing the user with a comfortable and balanced hand grip by which to carry the elongated unit, with its selected clubs loaded therein, the elongated handle provides a hook by which the unit can be hooked over the rim of the larger or parent golf bag when the latter is mounted in upright position on the back platform of a conventional motorized golf cart.

In one embodiment, the body portion of the carrier is composed of three tubes of a size to receive virtually all of the small and larger size club grips on the market today. The outer casing or shell of the carrier defines a substantially triangular shape of unique optimal shape, size and general configuration to be dropped through one of the partition openings usually built into the top opening of conventional golf bags proportioned to carry a full complement of clubs. Thus, when the carrier is not in use, it can be stored and carried totally nested inside its parent bag without unloading or removing the few selected clubs from the tubular body.

In play, the golfer, after having strapped the parent bag in upright position on the platform of a motorized golf cart, lifts the carrier from its nested position interiorly of the bag and hooks the handle over the rim of the bag and relatively deep into the bag interior. Assuming the carrier has a three-club capacity, a typical example might be as follows: The golfer knows from his own experience, for instance, that he will want to use one or more of three particular clubs—perhaps a 7 iron, an approach wedge and a putter—when he comes within his approach distance from a green, e.g., 75–125 yards out. Thus when he arrives at his destination within his approach range and has to leave the cart to walk some distance to where his ball lies, he can, with a single arm motion, grasp and lift the loaded carrier from its hooked suspension over the rim of the bag and march off fully equipped to hit any shot he or she may reasonably be expected to encounter from fairway to green.

When the golfer reaches the spot where his ball lies on the fairway and it is time to lay down his clubs to take his shot, he lowers (or lets fall) the carrier to lie flat on the grass with the hook-shape handle facing up. When the golfer has concluded his shot he may, without stooping over or bending from the waist, use the head of the club he has in hand to engage the underside of the hook and, by simple arm motion, raise the carrier to near waist high level within easy grasp of the handle by the golfer's free hand (see FIG. 9). The ability to swiftly lift the carrier from ground level using the club in hand, eliminates entirely the need to provide a ground spike or collapsible stand to try and maintain the carrier upright instead of letting it drop to the ground when the golfer has to take his next shot.

After each shot the golfer, having lifted the carrier from lying on the ground to stand-up position, can conveniently reinsert the free club back into the carrier or the like, during his continued walking to the next stop, where the same process is repeated—all this without the loss of any measurable time as would be the usual case if the golfer had to repeatedly lean completely over and gather together and pick up a plurality of individual scattered clubs deposited on the—oftentimes wet—grass while taking the next shot.

Using the present carrier, the golfer, after putting out, can simply walk over to the edge of the green, pick up the carrier (using the putter to hook-into the handle without bending over). Upon returning to his cart, the carrier, fully loaded, is again hooked over and suspended from the rim of the parent bag in readiness for immediate use when needed on the next hole.

Golfers playing on public or private courses either are, or should be, concerned about wasting time and thereby slowing play on the course. The use of the present invention in the way and manner given in the above example may realistically save a golfer up to 15 to even 20 minutes per 18 hole round in several ways as may be demonstrated: Firstly, the ordinary golfer when he gets within his approach range and is compelled to leave his cart and walk a distance from the cart path to his approach shot range, will usually take with him at least two or three clubs in addition to his putter. Typically when the cart stops, the disembarking golfer will walk around to his bag at the back of the cart and go through the club selection process almost always involving a visual search of all the clubs in his bag, some of which are turned to make difficult immediate identification, others of which are hidden under other clubs or head covers, etc. In any event this selection process occurring on the first hole and every hole thereafter, will waste a significant amount of time because our golfer subject will end up searching out and extracting from the parent bag the very same clubs he would have selected at the first tee and pre-loaded into the carrier. Whatever, the amount of wasted time in the selection process on the first hole, one can safely multiply this by 18.

The above repetitive "selection" process is but one of several major time-wasting repetitive processes absent the availability and convenient use of a golf carrier embodying the features of the present invention.

By way of further example, the same golfer alluded to above will waste more time in what may be called the "return the clubs" protocol, whereby after putting out each hole the golfer takes time to replace the selected clubs back into proper position in the parent bag to later proceed to go through the "selection" process described above all over again.

Perhaps the biggest time-waster of all, as well as a physical energy waster, involves the golfer hand carrying three or more approach clubs to the point on the fairway where he is going to make his first approach shot, and arriving at the spot, he selects one club to shoot with and scatters the remaining two or three clubs on the ground—often wet grass. After making his first approach shot, he must take the time and energy to scrape the clubs on the ground together and trek off to the next shot—just to repeat the whole process as many shots as it takes per hole to reach the green where all the clubs, save the putter, are again scattered.

Use of a golf carrier embodying the present invention can totally eliminate, for all practical purposes, the time wasting "selection" and "return the clubs" processes, as well as the back-breaking and time-consuming procedure of scattering the clubs and gathering them up again multiple times during each hole.

Conserving and reducing playing time on the course is not only beneficial to players, but is much sought after by the starter of any public or private course. The faster the play, the greater the course capacity and income.

A carrier embodying the present invention with its minimum of three clubs loaded therein can be slidably inserted through a partition opening of the parent bag and comfortably nested wholly within the said bag's interior during periods of transport and storage. This feature is made possible because the carrier body is generally made to define a rounded triangular shape in cross-section with rounded corners and dimensioned to be slid through at least one of multiple shape and size partition openings present in the conventional 8" to 10" diameter golf bag. The unique rounded triangular shape and dimensioning permits the carrier body to be rotated around its own lengthwise axis so as to optimally accommodate its own relatively longer and shorter dimensions to the maximum longer and shorter dimensions If of the partition opening into which the carrier is being inserted.

Further advantages obtained include the ability to keep clubs removed from the larger bag from having to lie scattered on wet grass and thereby be exposed to dampness as well as to eliminate the very significant waste of time and effort required of the golfer to repetitiously stoop over to gather up the clubs, only to scatter them on the ground again when the golfer comes to make his next shot.

Another object and advantage is that the particular design of the hook-shaped handle and its location of attachment to the carrier body permits a user to pick up the carrier and clubs loaded therein from the ground to within hand reach by merely engaging and lifting the handle with the head of the club the golfer holds without the golfer having to stoop or appreciably bend from his waist.

Because the slim and uniquely configured triangular-shaped carrier body may be inserted in the parent bag in nested position, there is no reason why the carrier need be stored or transported separately from the parent bag. This, in turn, leads to the further advantage of never running the risk of separating the few selected clubs loaded in the carrier from the full set of clubs of which the few are a part.

Also, because the carrier may be nested in the parent bag fully loaded with it several selected clubs, any appreciable crowding of clubs in the bag is avoided because the carrier takes up only a small fraction more in volume displacement than the loaded clubs would occupy if the selected clubs were removed from the carrier and placed individually in the bag.

Further objects and advantages of the invention will become apparent upon referring to the accompanying drawings and following specification.

BRIEF DESCRIPTION OF THE DRAWINGS

FIG. 1 is a fragmentary side elevational view of the carrier in horizontal position, and showing how a fourth club may be nested in the handle groove to facilitate carrying of the club.

DETAILED DESCRIPTION OF THE INVENTION

Figure 1:
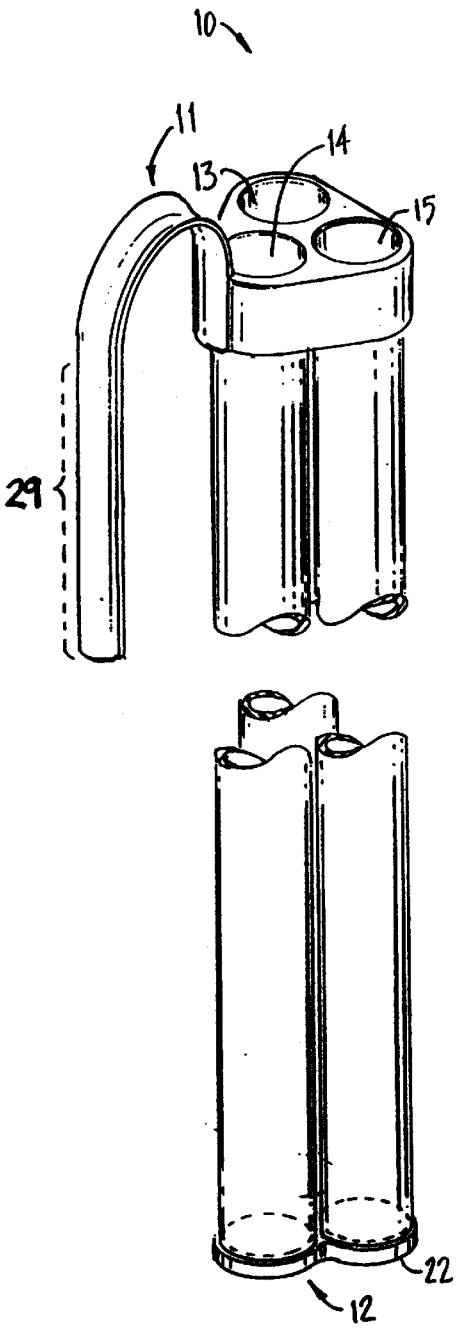
FIG. 1 is a perspective view viewed from the top and side of the invention.

Referring more specifically to the drawings, FIG. 1 shows the combination of an elongate, relatively slender tubular body portion, indicated generally at 10, a hook-shaped handle assembly indicated generally at 11, and a bottom closure assembly indicated generally at 12.

Figure 3:
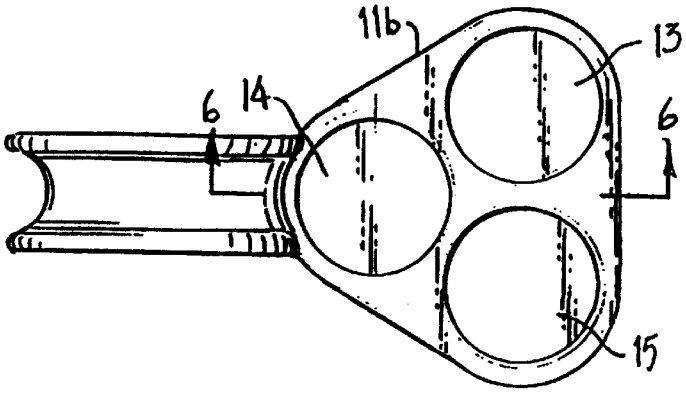
FIG. 3 is a top plan view.

FIGS. 1 and 3 clearly show that the body 10 may be comprised of three separate tubes of equal length made of thin-walled, relatively rigid plastic such as, for example, polyethylene, PVC, or ABS plastic formulations. The three tubes are clustered together in a substantially triangular-shaped formation (viewed in cross section), and held together at their adjoining tops by the handle assembly 11, and at their bottoms by closure 12. Because a major advantage of the invention is to configure the carrier so that it can be dropped through the partition opening found in the standard 8 to 10 inch diameter golf bag, it is important to not make the tubes of any larger diameter than can collectively between them receive virtually any large club grip that a golfer might be expected to use. By combining two 1¼" to 1⁵⁄₁₆" tubes 13 and 14 with one larger tube of 1½', this combination will accommodate a virtually any size wood or iron grip, and that the larger diameter tube 15 will accommodate any conventional size or shaped putter grip. This particular combination of different size tubes, when clustered as shown in a rounded, three-cornered generally triangular shape, will fit into at least one partition opening of standard size full capacity golf bag.

The handle assembly indicated generally at 11 may be extrusion molded as a single part, or the hook-shaped part 11*a* may be separately fabricated apart from the cap segment 11*b*. If separately made, the handle 11*a* may be secured to cap 11*b* by any conventional suitable mechanical or adhesive means of attachment (not shown).

Figure 6:
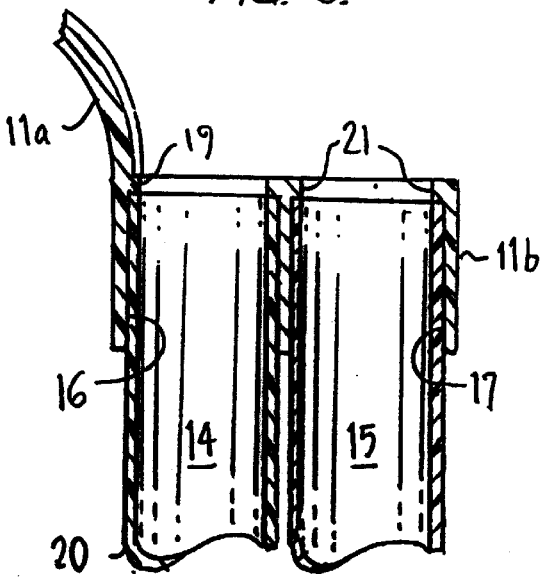
FIG. 6 is a sectional view taken along line 6–6' of FIG. 3.
Figure 5:
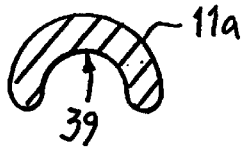
FIG. 5 is a cross-sectional view taken along line 5–5' of FIG. 4.

FIG. 6 shows in cross-section now the tube receiving cap 11*b* is formed with individual recesses or bores, such as referenced by numerals 16 and 17 in FIG. 6. These recesses, in turn, are dimensioned to snugly receive associated upper ends of the 3 tubes—it being noted that only the recesses 16 and 17 which receive tubes 14 and 15 are shown in FIG. 6, with the understanding that a third recess, identical to recess 14 is also formed in the cap to receive tube 14. The recesses 16 and 17 extend upwardly to within a short distance of the top surface of the cap 11*b* whereat circumferential internal flanges 19 and 21 project inwardly from the plane of the respective recess walls a distance substantially equal to the wall thickness 20 of the tubing 14 and 15. The flanges act as stops to prevent the tubes from projecting upwardly above the top surface of the cap. Because the amount of inward projection of the stop flanges is equal to the tubing wall thickness 20, the maximum diameters of the respective tubes are not decreased at their top entrance openings where the grip ends of the clubs are first inserted into the tubes.

The tubes 13, 14, and 15 may be permanently bonded at the upper ends within the confines of the recesses in the cap by a suitable adhesive (not shown), selected from whatever class of adhesives are commercially formulated to effectively work with the types of plastics or other material the parts to be bonded are made of.

Figure 12:
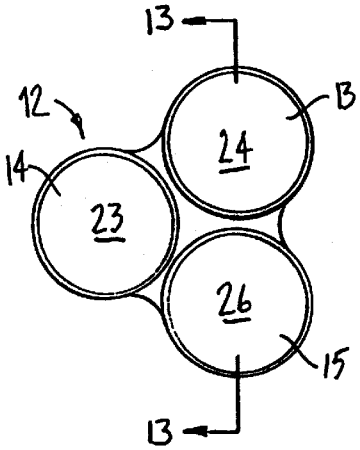
FIG. 12 is a top plan view of the bottom closure assembly.
Figure 13:
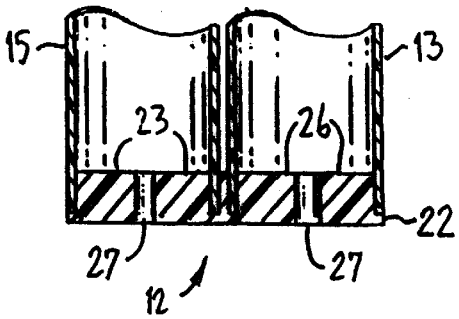
FIG. 13 is a sectional view along line 13–13' of FIG. 12.

The bottom closure assembly, indicated generally at 12, is shown in FIGS. 12 and 13 as an integrally molded plastic part consisting of a base 22 formed with three upwardly extending plugs 23, 24, and 26 (FIG. 12). These plugs are dimensioned to snugly be inserted into and plug an associated bottom tube end and be adhesively bonded or otherwise securely attached thereto.

A requisite number of drain holes, referenced collectively by numeral 27 (FIG. 13), are formed through base 22 in alignment with the bore of each tube. Thus, if the golfer is caught in a rain storm while on the course, water is prevented from collecting in any of the tubes, thereby avoiding any risk of soaking the club grips.

Figure 2:
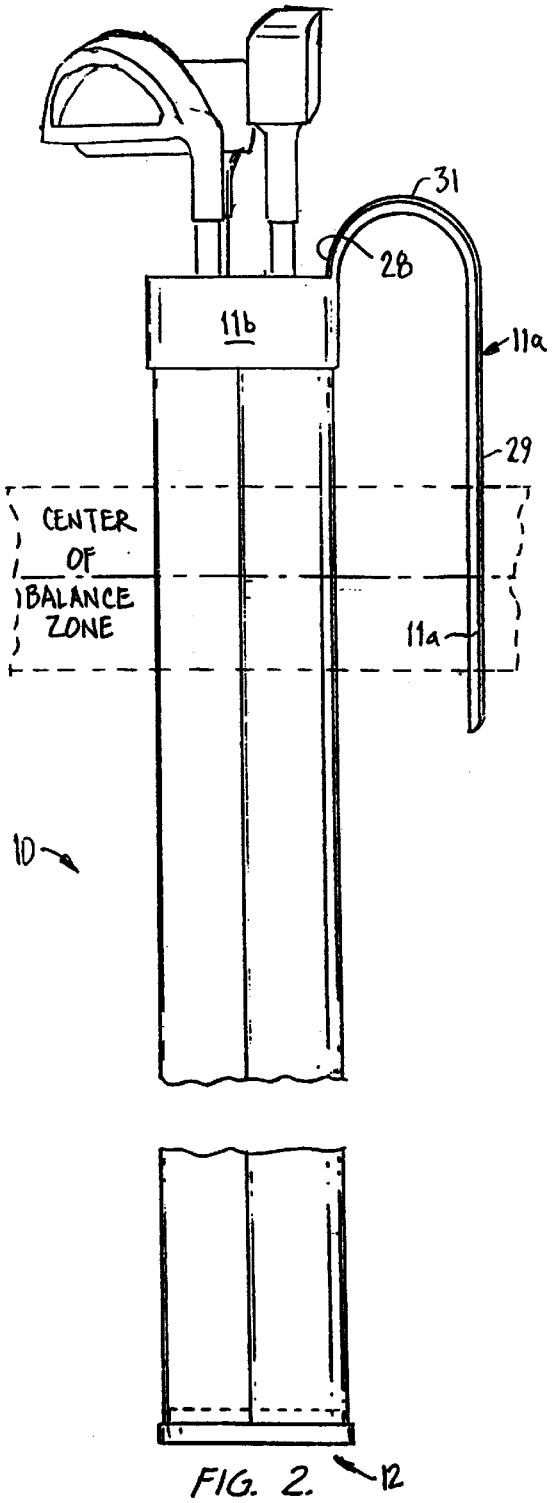
FIG. 2 is a side elevational view.

Referring to FIG. 2, hook-shaped handle portion 11*a* of handle assembly 11 is defined by an inner leg 28, and an elongate outer leg 29 integrally connected by an arched web portion 31. The inner leg 28 integrally attached to the cap 11*b* may extend above the top surface of the body portion and the cap so that the arched web, which defines the hook portion also preferably extends a distance above the cap and body portion. The outer elongate outer leg depends downwardly, parallel to the inner leg and parallel to the body portion a significant distance below the cap and top extremities of the body to a point nearing the center of gravity of the carrier when the latter is loaded with its complement of pre-selected clubs. More specifically, FIG. 2 shows the designation "center of balance zone." The center horizontal dotted line of the designated center of balance zone is close to the predetermined center of gravity of the carrier when loaded to capacity with it's three clubs as shown in the embodiment illustrated in the drawings. The exact center of gravity or precise point of balance along the body of the carrier will vary according to variances in club head weight as well as the number of clubs actually in the carrier at any given time. The heavier the club heads and the more clubs occupying the carrier body, the farther up the body will be the balance point. Thus, the phrase "center of balance zone" as used herein designates an approximate area where the true center of balance may shift a bit up or down along the carrier depending mainly on the weight and respective lengths of clubs loaded in the carrier at any given time.

Figure 8:
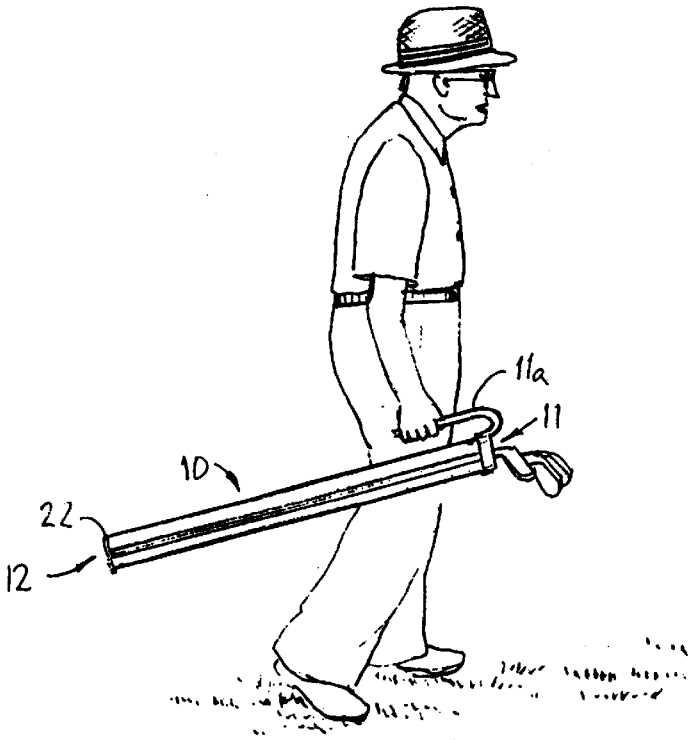
FIG. 8 is a partly schematic view of how the invention may be hand carried in near horizontal and balanced position.

It is important to the convenience and comfort of a user to locate the lower end of the handle within the center of balance zone, but with the outer leg hand grip area 29 (see FIG. 1) located slightly above the estimated center of gravity within the zone. The reason for this positioning of hand grip area is so that the carrier will assume a fairly balanced and near horizontal position in the hand, yet always with the center of balance being such that the forward (top) end of the carrier will be tilted slightly upwardly. If the balance were such as to allow the forward end to tilt downwardly, the risk of the clubs sliding out of their associated tubes would be high. FIG. 8 illustrates how the carrier naturally balances itself in the hand of a user because of the positioning of the handle in reference to the center of balance zone described above.

Figure 4:
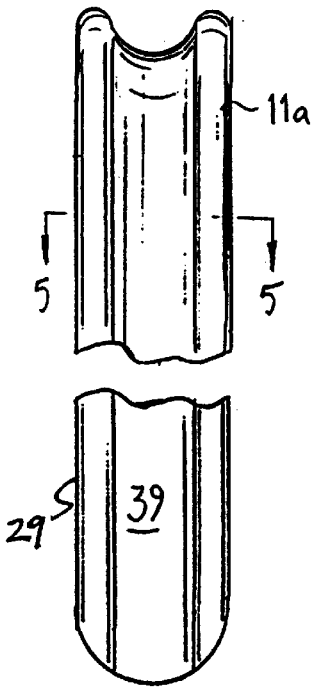
FIG. 4 is a front elevation view of the outer leg of the hook-shaped handle and special groove formed therein.
Figure 11:
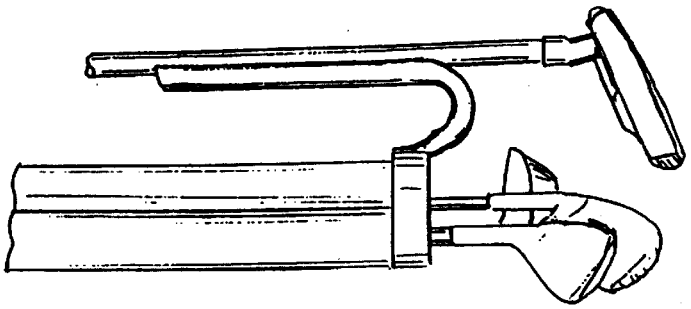

The outer leg 29 is formed with a half-round groove 39 (FIG. 4) extending its full length from the outer leg's point of joinder to the arched web at its upper end extending down to its terminal point in the balance zone. FIG. 11 shows how the groove can accommodate the shaft of a fourth club for convenient manual gripping and carrying.

Figure 7:
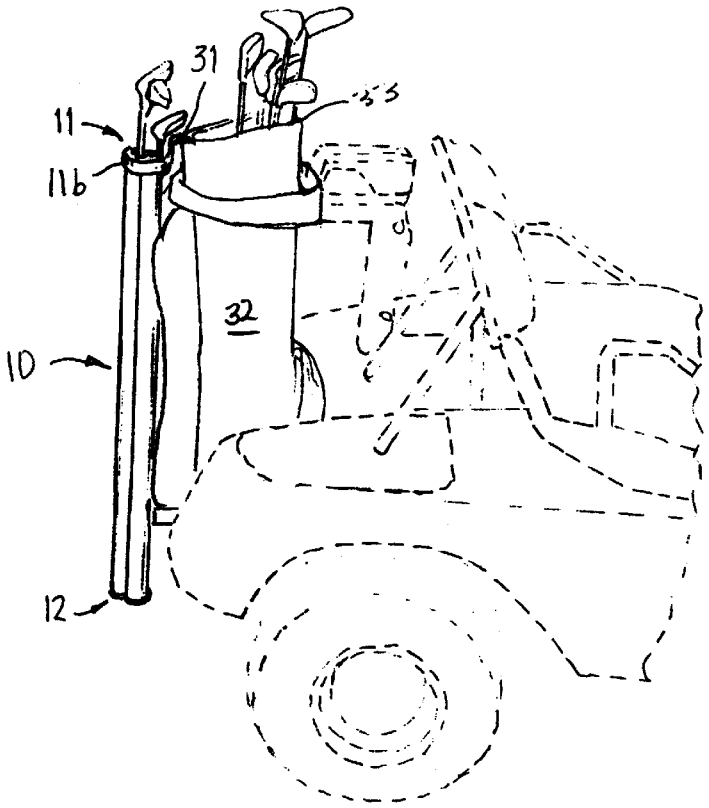
FIG. 7 is a partially schematic side elevational view of the rear platform of a conventional motorized golf cart, a full club capacity golf bag mounted thereon, and a limited capacity club carrier embodying the invention hooked over the rim of the bag.
Figure 14:
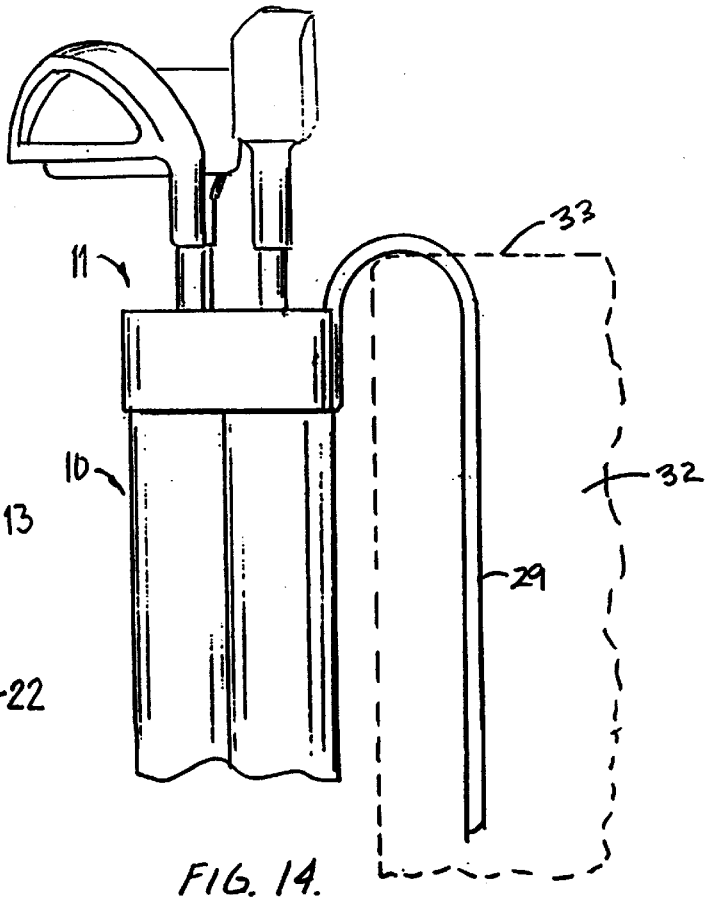
FIG. 14 is a fragmentary view of the invention showing the manner in which the handle is hooked over a conventional golf bag outlined in phantom lines.

FIGS. 7 and 14 illustrate another desirable structural and functional feature of the invention. In particular, there is shown in phantom lines the outline of a conventional full club capacity golf bag 32 and the manner by which the handle hooks over the rim 33 of the bag 32 which, in turn, may be assumed to be secured upright on the platform of a motorized golf cart. It is to be noted that because the arched web 31 is located above the top of the carrier, when the bag rim 33 is engaged by the hook, the top of the suspended carrier is maintained at a location below the plane of the bag rim 33. This stabilizes the carrier with its loaded clubs from any pendulum movement. The elongate outer leg 29 of the handle extends well down into the interior of the bag well below the open top of the body portion. This insures there is no practical possibility of the engaged hook "bouncing" up out of the bag due to travel of the cart over rough terrain.

Figure 9:
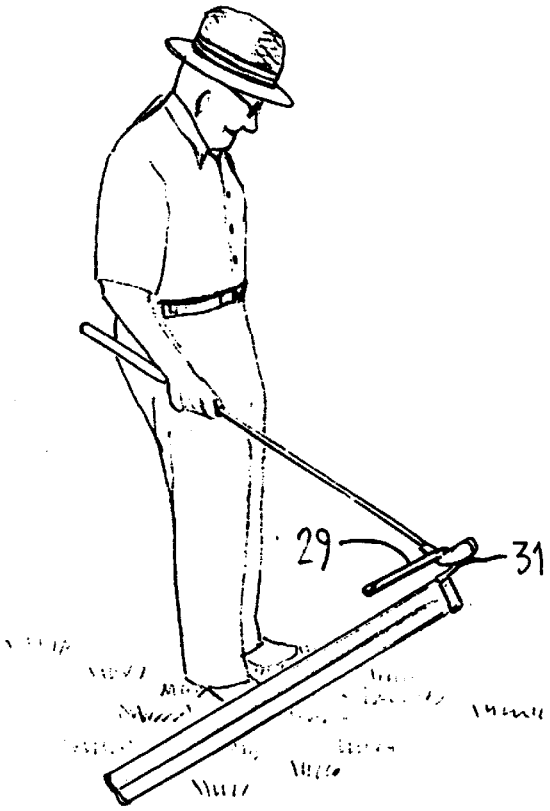
FIG. 9 is a partly schematic view showing a golfer lifting the carrier off the ground by engaging the hook-shaped handle with a club head.

FIG. 9 discloses how a golfer may both raise and lower the carrier in reference to ground level without having to bend from his waist or move his upper body to any appreciable degree. Specifically the elongate outer leg 29 of the handle in conjunction with its spaced parallel relationship with the upper body portion of the carrier, permits a golfer to engage the head 31 of the club he has in hand with any part of the underside of the leg 29 to raise the unit to above knee level and within easy hand grasp by the user's free hand without stooping over or making any other type of uncomfortable body movement. Without the carrier, any extra clubs beyond the club the golfer has in hand would have to be laid scattered on the grass, wet or dry. This, in turn would require the player to repeatedly stoop to ground level to gather the clubs together and balance them in his hand to walk to the next stop where he would have to repeat the same process an untold number of times during 18 holes of play.

On the other hand, if a golfer using the present carrier wishes to carry with him more clubs than the unit will hold, he need only lay the grips of the extra clubs cross-wise on top of the carrier (not shown) to keep the grips spaced above ground level.

Figure 15:
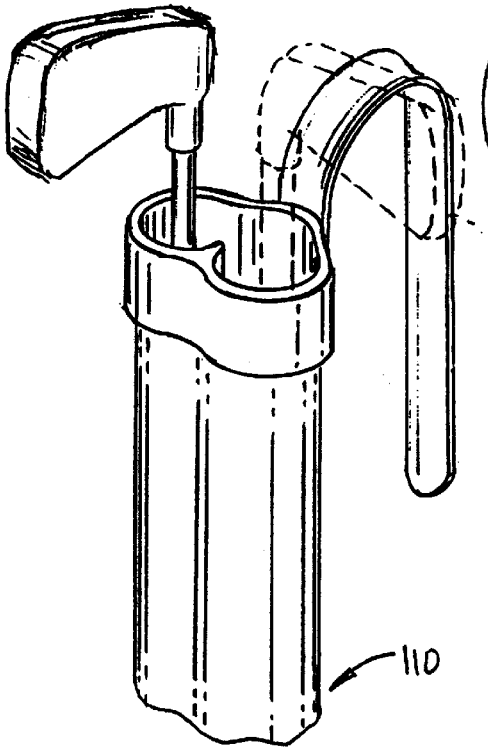
FIG. 15 is a top plan view of a second embodiment of the invention.
Figure 15:
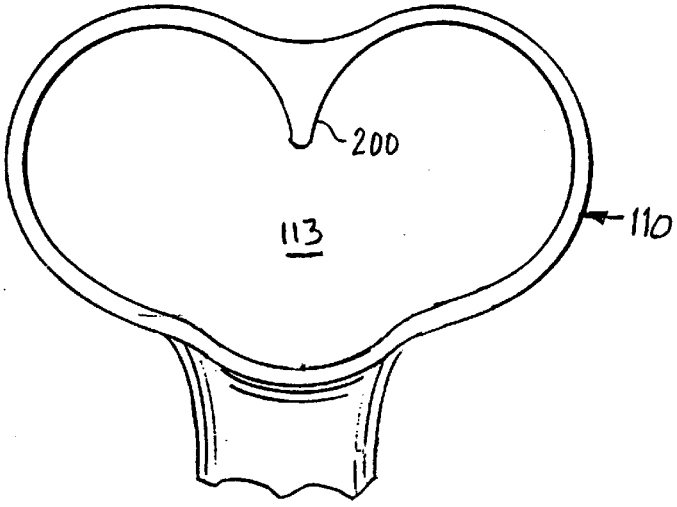
Figure 16:
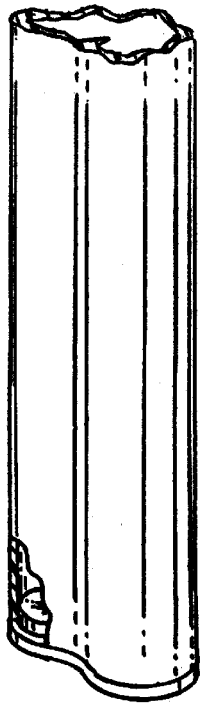
FIG. 16 is a perspective view viewed from the top and side of the second embodiment.

A second embodiment of the invention is illustrated in FIGS. 15 and 16.

These drawings reveal that the body portion 110 of the carrier defines a single hollow generally triangular-shaped tube as distinguished from the multiple tube construction of the first embodiment. The body portion may also be fabricated out of a relatively rigid plastic such as extruded ABS or DVC.

The cross-sectional shape of the body portion as shown in FIG. 16 is in the form of a roundeded off triangular shape of predetermined dimensions having three rounded corners and dimensioned to slip through one of the varied size top partition openings found in the vast majority of standard full size 8 inch to 10 inch diameter golf bags on the market today—thus permitting the carrier to be dropped through the usual partition opening of a golf bag and be nested therein as explained above. A long dimension of about 3½" to 4" and a short dimension of about 2¼" to 2½" will fit most conventional golf bags. The large majority of conventional standard size (8–10" diameter top openings) golf bags on the market today incorporate a criss-cross pattern of webs or ribbons, such as designated at 40 in FIG. 10, which is turn define multiple openings of potentially square, elongate rectangular, and/or half-moon shapes of somewhat varying dimensions between opposing partition walls. Making the carrier body in the rounded triangular shape above noted, and also formed with the distance measured between the apex 'A' and the base 'B' (FIG. 15) being shorter than the distance of the base provides the optimal shape for "finding a fit" for the carrier body to accommodate itself to at least one of the variously shaped and dimensioned partition openings of a standard size conventional bag. By axially rotating the carrier, the long and short cross-sectional dimensions of the carrier can be oriented to fit without the maximum obtainable long and short dimensions of any given opening.

FIG. 15 shows a central ridge 200 extending the interior length of the body. This ridge is designed to act as a semi-partition between contiguous clubs loaded in the bag in order to lessen any likelihood of contiguous club grips and/or shafts criss-crossing each other when loaded in the carrier.

Figure 10:
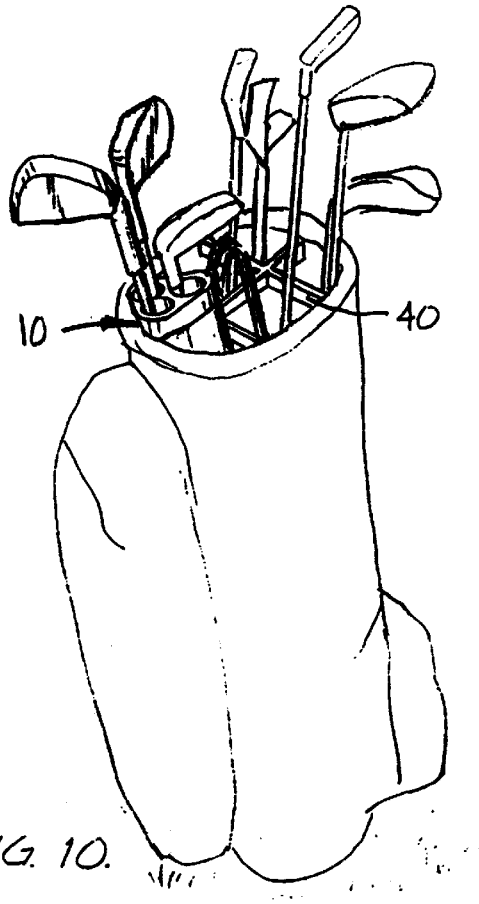
FIG. 10 is a partly schematic view showing the invention with its pre-selected clubs still loaded therein nested entirely within the interior of the parent golf bag.

FIG. 10 discloses how an elongate carrier embodying the invention, during storage and travel, can be dropped through one of multiple partition openings built into most conventional 8" to 10" diameter bags to a nested position solely within the confines of the bag's interior including the entire hook-shaped handle assembly 11. As heretofore mentioned, the carrier preferably is loaded and nested into the parent bag without removing any of the selected clubs loaded into the carrier. Because of the fact that the individual tubes are of only slightly greater diameter than the respective grips on the clubs which the tubes hold, coupled with the fact that the tubes are arranged in a triangular shape cluster as above described, the volume displacement of the slender body is not significantly larger than the space the selected clubs would occupy in the bag if they were inserted into the bag individually. Thus, there is no genuine concern that the carrier, when still loaded with its selected clubs will crowd the remaining clubs in the bag.

Figure 17:
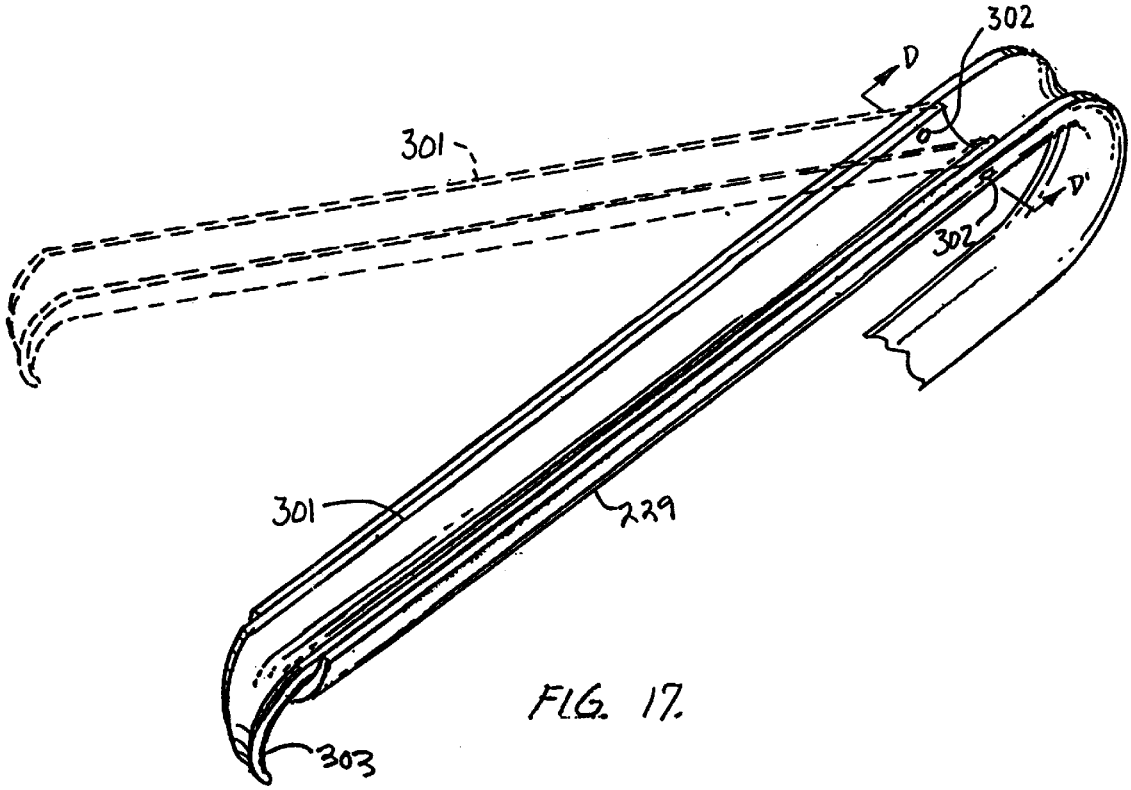
FIG. 17 is an enlarged fragmentary perspective view of a modified hook.
Figure 18:
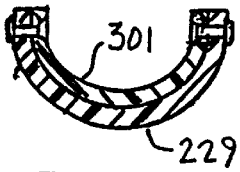
FIG. 18 is a cross-sectional view taken along line D–D' of FIG. 17.

FIGS. 17 and 18 disclose a modified U-shaped handle portion of basically the same design and construction as previously described in reference to handle portion 11, but with the addition of a lift bar 301.

The outer leg 229 of the handle portion is formed with a half-round groove of a shape and size to accommodate the shaft of a fourth club (see FIG. 11). The lift bar 301 is complementally shaped and sized to normally overlie, in the nested position, the grooved outer leg throughout the latter's entire length. The lower end of the lift bar 301 terminates in a tapered, downwardly bent finger grip 303, and the upper end of the lift bar is hingedly attached by hinge pins 302 to the upper end of outer leg 229 so that the bar may be swung at least 90° outwardly from its normally nested position overlying the grooved outer leg.

Figure 19:
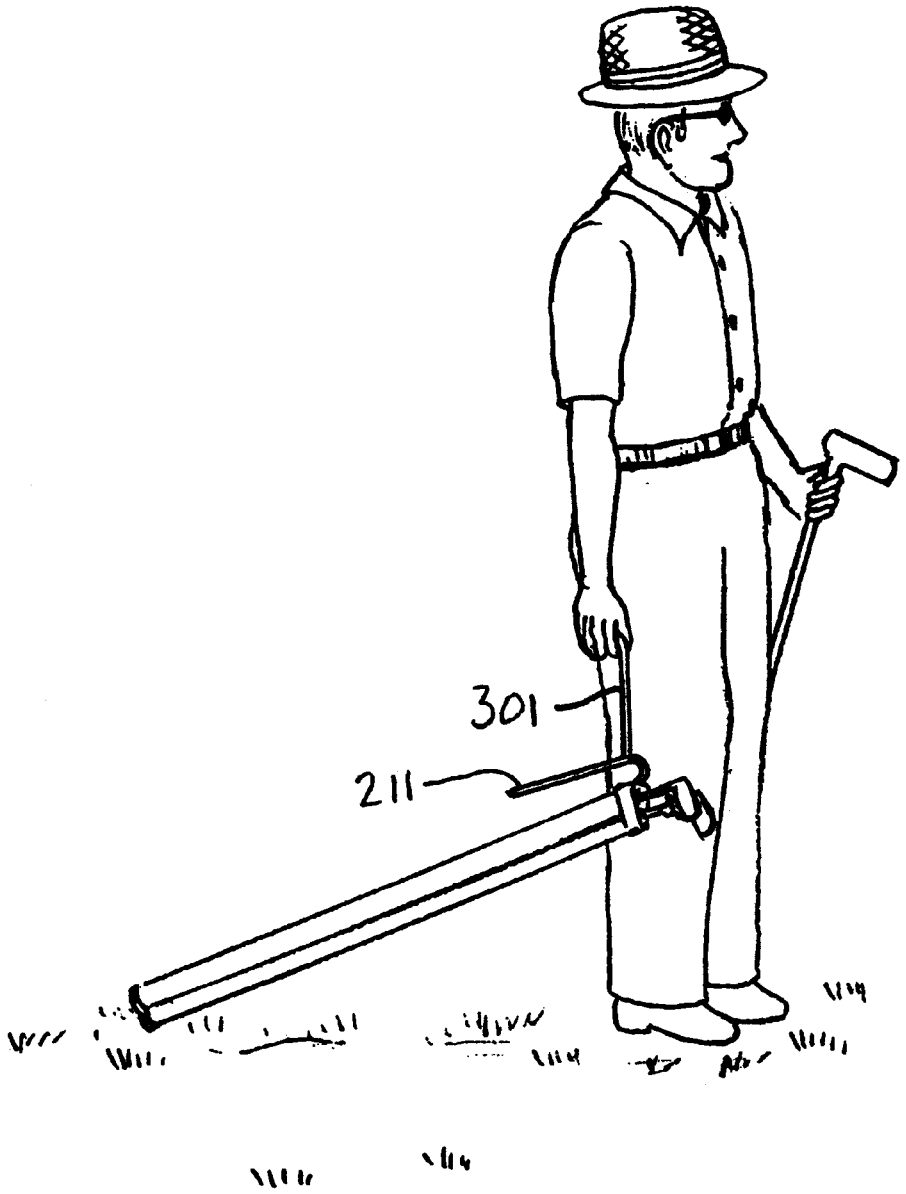
FIG. 19 illustrates how the carrier can be picked up with a lift bar.

FIG. 19 illustrates how a golfer with minimum bending from his back and knees can lower or drop his hand sufficiently from a standing position to engage the upwardly projecting finger grip 303 of the lift bar 301 to comfortably lower and raise the carrier to and from a horizontal position lying on the ground.

As earlier explained at considerable length under the heading "Objects and Advantages of the Invention" one of the most valuable advantages in using a carrier embodying the invention in the ways described, is the great savings of time that a golfer must otherwise spend in the tedious repetition of the same and time consuming acts—such as, for example, the wasted time spent in repetitiously locating, choosing, and removing the exact same three or four clubs from the parent bag whenever within approach range, plus a similar delay when it comes time to put these same clubs back into the bag.

Although the drawings and much of the above specification text focuses on a three-club holding capacity carrier for approach situations within an estimated yardage range, it is understood that the carrier may variously be used to carry a selected few long and mid-range fairway woods and/or irons as desired.

In order to avoid changing clubs around using only one small capacity carrier per parent bag, the unit described herein is so comparatively compact and slender that it is expeditious for a golfer to carry two units to hook over the rim of a single bag. The first bag can be more or less "permanently" loaded with selected approach clubs and used exclusively in approach situations, whereas the second carrier can be used to carry any fairway clubs to be selected and loaded at the moment of need when the golfer must leave his cart and walk to remote points on the fairway (a not uncommon situation when no carts are allowed off the cart paths).

It is also visualized that it would be feasible to customize or modify golf bag construction to accommodate two or more compact carriers that would collectively and cooperatively fit and nest inside the interior of the bag, but would also each be separately removable from the interior and hooked over the rim of the parent bag the same as described hereinabove with reference to using only one carrier. Although the invention has been described in some detail by way of illustration and example, it is understood that the invention is limited only by the scope of the claims appended hereto.

What is claimed is:

1. A compact golf club carrier for use in conjunction with a conventional standard size golf bag having a partitioned top club entrance opening, and with the bag strapped in position on the platform of a motorized golf cart, comprising the combination:

an elongate tubular hollow body portion having a top open end and a closed bottom end;

said body portion in cross-section being generally of a three rounded corner triangular shape dimensioned to receive the grips and shafts of not less than three clubs selected from a larger set of clubs normally contained in said conventional golf bag;

a hook-shaped handle portion having an inner leg and an outer leg integrally joined by an arched web portion;

said inner leg rigidly mounted to said body portion adjacent the top open end thereof;

said outer leg depending downwardly from its point of integral joinder with said arched web portion in spaced parallel relationship to said inner leg and body portion; and said outer leg being longer than said inner leg and depending downwardly to a terminal point located substantially below the point where said handle is rigidly mounted to said body portion adjacent said top open end;

wherein said spaced parallel outer leg is shaped and proportioned to define a manual finger gripping surface to permit a user to engage the fingers of one hand and carry said carrier with the selected few clubs loaded in said body portion with the club grips and shafts loosely nested in the tubular body and the club heads projecting outwardly from the top end thereof;

wherein said tubular body with its maximum number of clubs loaded therein has a predetermined center of balance zone located at a point along the said elongate body portion when the loaded carrier is held at or near horizontal position; and wherein said terminal point of said downwardly depending outer leg is located within said predetermined center of balance zone to enable a user to carry said carrier by said handle in a near balanced horizontal position.

2. The combination of claim 1, and wherein the size and shape of the spacing between the outer leg and parallel inner leg and adjacent body surfaces permits said handle to be hooked over the rim of a conventional golf bag in upright position, with the outer handle extending a sufficient distance into the interior of said bag to insure that virtually no amount of bouncing or application of incidental forces influencing the carrier to move upwardly could not accidentally dislodge the carrier from its hooked engagement with the rim of the bag.

3. The combination of claim 1 and wherein the generally triangular-shaped cross-section of the tubular body is dimensioned to confine the minimum three clubs in a compact non co-planar clustered arrangement in close adjacency to each other so as to present an exterior tubular body shape and size for optimally fitting into a conventional golf bag partition opening.

4. The combination according to claim 1 and wherein said outer leg is formed with a rounded groove extending from its point of joinder with said web portion at the upper end of said outer leg to the lower terminal end of said outer leg;

said groove dimensioned to snugly receive and nest a portion of the shaft of a golf club adjacent its club head end.

5. The combination of claim 1 and further including:

an elongate manual lift bar having first and second ends;

said bar shaped and proportioned to normally overlie the top surface of said outer leg from its point of joinder to said web portion at the upper end of said outer leg to its lower terminal end of said outer leg;

hinge means mounted on the upper end of the outer leg adjacent its point of joinder to said web portion;

said first end of said lift bar hingedly connected by said hinge means to the upper end of said outer leg;

said lift bar swingable arcuately from its normally said overlying position outwardly 90° from the plane of said outer leg, whereby when the tubular carrier is laid horizontally on the ground said lift bar projects upwardly;

and a finger grip extension attached to the second end of said lift bar to permit a user to engage a finger with said bar to lift said carrier off the ground with minimum bending over.

* * * * *